US008690641B2

(12) United States Patent
Mase et al.

(10) Patent No.: US 8,690,641 B2
(45) Date of Patent: Apr. 8, 2014

(54) APPARATUS FOR SUPPLYING CONSTANT AMOUNT OF ABRASIVE

(75) Inventors: Keiji Mase, Tokyo (JP); Katsuhiro Shikano, Tokyo (JP)

(73) Assignee: Fuji Manufacturing Co. Ltd., Edogawa-Ku, Tokyo (JP)

( * ) Notice: Subject to any disclaimer, the term of this patent is extended or adjusted under 35 U.S.C. 154(b) by 517 days.

(21) Appl. No.: 13/115,481

(22) Filed: May 25, 2011

(65) Prior Publication Data

US 2012/0015593 A1 Jan. 19, 2012

(30) Foreign Application Priority Data

Jul. 13, 2010 (JP) ..... 2010-159085

(51) Int. Cl.
*B24C 7/00* (2006.01)

(52) U.S. Cl.
CPC ..... *B24C 7/00* (2013.01); *B24C 7/0092* (2013.01)
USPC ..... 451/99

(58) Field of Classification Search
CPC ..... B24B 7/00; B24B 7/0046; B24B 7/0092
USPC ..... 451/99
See application file for complete search history.

(56) References Cited

U.S. PATENT DOCUMENTS

| | | | | |
|---|---|---|---|---|
| 6,200,203 | B1 * | 3/2001 | Xu et al. | 451/99 |
| 6,824,450 | B2 * | 11/2004 | Opel | 451/53 |
| 6,890,246 | B2 * | 5/2005 | Yamaharu | 451/99 |
| 6,971,554 | B2 * | 12/2005 | Rochat | 222/370 |
| 7,695,349 | B2 * | 4/2010 | Mase et al. | 451/99 |
| 7,695,350 | B2 * | 4/2010 | Mase et al. | 451/99 |
| 7,775,857 | B2 * | 8/2010 | Jonkheijm et al. | 451/40 |
| 8,430,722 | B2 * | 4/2013 | Raeder et al. | 451/99 |
| 2003/0064665 | A1 * | 4/2003 | Opel | 451/40 |
| 2006/0178092 | A1 * | 8/2006 | Spivak et al. | 451/99 |

FOREIGN PATENT DOCUMENTS

| | | |
|---|---|---|
| JP | 2008-264912 | 11/2008 |
| JP | 2009-208185 | 9/2009 |

* cited by examiner

*Primary Examiner* — Maurina Rachuba
(74) *Attorney, Agent, or Firm* — Shlesinger, Arkwright & Garvey LLP

(57) ABSTRACT

An apparatus for supplying a constant amount of abrasive which can supply even dry ice particles, ice particles, or the like as abrasive in a constant amount is provided. In order to take out abrasive contained in measuring holes 21 of a rotating disc 20, an abrasive mixing section 40 for blowing a compressed gas into each of the measuring holes 21 has a cylinder 41' which opens toward one surface of the rotating disc at the position where the measuring holes are formed. A piston 43' is inserted into the cylinder. A fluid channel 45 opens toward the cylinder 41' through the intermediary of the rotating disc 20 and whose opening rim 45*a* is in sliding contact with another surface of the rotating disc 20. One of the cylinder 41' and the fluid channel 45 communicates with a compressed-gas supply source through the intermediary of a compressed-gas introduction path 52. The other one of the cylinder 41' and the fluid channel 45 communicates with the abrasive transport path 51. The piston 43' has a through-hole 43*a* passing therethrough in such a manner as to coincide with the position where the measuring holes are formed.

20 Claims, 9 Drawing Sheets

APPARATUS FOR SUPPLYING CONSTANT AMOUNT OF ABRASIVE

BACKGROUND OF THE INVENTION

1. Field of the Invention

The present invention relates to an apparatus for supplying a constant amount of abrasive, and more particularly, to an apparatus for supplying abrasive which is suitably used for supplying a constant amount of abrasive to a blast gun together with compressed gas in a blasting process in which abrasive is ejected from the blast gun together with compressed gas and blown and bombarded against a workpiece for processing the workpiece.

2. Description of the Related Art

In a blasting process in which abrasive is ejected from a blast gun together with compressed air for, for example, cutting, deburring, or cleaning a workpiece, any variation in the ejected amount of abrasive results in variation in the extent of processing, leading to uneven processing or the like with a resultant failure to uniformly maintain processing accuracy at a fixed level.

Thus, in order to eject a constant amount of abrasive at all times from a blast gun of a blasting machine, there is proposed an apparatus for merging a predetermined amount of abrasive with compressed gas and introducing the resultant mixed fluid to the blast gun so that a constant amount of abrasive can be ejected continuously and constantly from the blast gun.

Regarding one example of such an apparatus, the applicant of the present application has proposed an apparatus 100 shown in FIG. 7 (Prior Art).

The apparatus 100 shown in FIG. 7 (Prior Art) is configured as follows. A rotating disc 120 which rotates horizontally is provided within an abrasive tank 110 which is constructed as a pressure vessel. An opening at one end 111*a* of an abrasive transport path 111 is disposed close to or in contact with one surface of the rotating disc 120. An opening at one end 112*a* of an air introduction path 112 is disposed close to or in contact with another surface of the rotating disc 120 in such a manner as to face the opening at the one end 111*a* of the abrasive transport path 111. A plurality of measuring holes 121 are bored in the rotating disc 120 in such a manner as to pass therethrough in the thickness direction of the rotating disc 120 and in such a manner as to be disposed at equal intervals on a rotation orbit of the measuring holes 121 which passes between the opening of the abrasive transport path 111 and the opening of the air introduction path 112.

The rotating disc 120 having the measuring holes 121 bored therein is rotated at a constant speed. By this operation, abrasive contained in the abrasive tank 110 is charged into the measuring holes 121, and the abrasive contained in each of the measuring holes 121 reaches a clearance between the air introduction path 112 and the abrasive transport path 111. In the clearance, a compressed-air flow from the air introduction path 112 to the abrasive transport path 111 acquires the abrasive from each of the measuring holes 121 and is mixed with the abrasive. The resultant two-phase fluid composed of solid and gas is supplied to a blast gun.

The abrasive to be supplied to the blast gun as mentioned above is charged into the measuring holes 121 provided in the rotating disc 120, thereby being measured in a constant amount. Thus, by means of varying the rotational speed of the rotating disc 120, the amount of supply of abrasive to the blast gun can be varied. When the rotating disc 120 is maintained at a constant rotational speed, a constant amount of abrasive can be constantly supplied to the blast gun (refer to Japanese Unexamined Patent Publication Nos. 2008-264912 and 2009-208185).

The apparatus 100 described above with reference to FIG. 7 (Prior Art) is excellent in the following points: the amount of supply of abrasive can be varied easily through control of the rotational speed of the rotating disc 120, and abrasive can be supplied in a constant amount with high accuracy.

The apparatus 100 described above with reference to FIG. 7 (Prior Art), however, has a structure in which abrasive charged beforehand in the abrasive tank 110 constructed as a pressure vessel is ejected by means of the internal pressure of the abrasive tank 110, so that during blasting work the abrasive tank 110 cannot be replenished with abrasive. Therefore, before blasting work is started, the abrasive tank 110 must be charged with a predetermined amount of abrasive.

Thus, the apparatus 100 cannot supply, for example, dry ice particles, ice particles, or the like in a constant amount, since if such particles are left in a heap, the particles adhere to one another to form lumps by the effect of, for example, moisture in air, resulting in a failure to charge the measuring holes 121 with the particles.

FIG. 8 exemplifies a conceivable configuration for using dry ice particles or ice particles as abrasive. Specifically, an abrasive charge section 230 is provided for allowing abrasive to fall therethrough without application of pressure so as to charge the abrasive into the measuring holes 221 of the rotating disc 220. Thus, a required amount of abrasive is introduced appropriately and continuously into the abrasive charge section 230 without involvement of stacking of abrasive for a long period of time, thereby charging the measuring holes 221 of the rotating disc 220 with abrasive.

In the case where the structure of the abrasive charge section 230 has been modified as mentioned above, if one end 212*a* of an air introduction path 212 and one end 211*a* of an abrasive transport path 211 with the rotating disc 220 intervening therebetween are not disposed within a pressure vessel, as shown in FIG. 8, compressed air and abrasive leak out through rotation allowance clearances δ between the front surface of the rotating disc 220 and the one end 212*a* of the air introduction path 212 and between the back surface of the rotating disc 220 and the one end 211*a* of the abrasive transport path 211. Therefore, the abrasive cannot be supplied in a constant amount.

In the apparatus 100 described above with reference to FIG. 7 (Prior Art), in order to ensure smooth rotation of the rotating disc 120, the rotation allowance clearances δ are provided between the one end 112*a* of the air introduction path 112 and the front surface of the rotating disc 120 and between the one end 111*a* of the abrasive transport path 111 and the back surface of the rotating disc 120. Even though the rotation allowance clearances δ are provided, compressed air in the air introduction path 112 and a mixed fluid in the abrasive transport path 111 do not leak out through the rotation allowance clearances δ to the exterior of the apparatus 100, since the region associated with the clearances δ is accommodated within the pressurized abrasive tank 110.

However, in the configuration of FIG. 8 in which the one end 212*a* of the air introduction path 212 and the one end 211*a* of the abrasive transport path 211 with the rotating disc 220 intervening therebetween are not disposed within a pressure vessel, a high-pressure compressed gas introduced from a compressed-gas supply source leaks out to the ambient atmosphere through the rotation allowance clearance δ between the surface of the rotating disc 220 and each of the air introduction path 212 and the abrasive transport path 211. Accordingly, not only does the pressure of the compressed gas to be supplied to the blast gun drop greatly, but also the abrasive leaks out in association with the leakage of the compressed gas. As a result, a work environment is contaminated with the abrasive, and the amount of abrasive to be supplied to the blast gun reduces, with a resultant failure in constant supply of abrasive in a constant amount.

In view of these circumstances, the present invention was made to overcome problems associated with the above-described existing techniques. An object of the present invention is to provide an apparatus for constantly supplying a constant amount of abrasive in which abrasive is mixed with a compressed gas for supplying the resultant two-phase fluid composed of solid and gas and which, even in the case of a rotating disc being disposed outside an abrasive tank, can supply a constant amount of abrasive at all times without involvement of leakage of the compressed gas, and thus can supply even dry ice particles, ice particles, or the like as abrasive, in addition to ordinary abrasives, in a constant amount.

SUMMARY OF THE INVENTION

In the following explanation of the Summary, reference numerals are referred as of the Embodiment in order to easily read the present invention, however, these numerals are not intended to restrict the invention as of the Embodiment.

In order to achieve the above objective, an apparatus 1 for supplying a constant amount of abrasive which supplies a mixed fluid composed of a compressed gas and the abrasive, comprises:

a rotating disc 20 which rotates in a horizontal direction and has a plurality of measuring holes 21 having the same diameter, bored in such a manner as to extend through the rotating disc 20 in a thickness direction of the rotating disc 20, and disposed at equal intervals along a circumferential direction;

an abrasive charge section 30 for allowing the abrasive to fall therethrough without application of pressure so as to charge the abrasive into the measuring holes 21 of the rotating disc 20; and an abrasive mixing section 40 disposed in such a manner as to straddle the rotating disc 20 from opposite sides of the rotating disc 20 at a position corresponding to a rotation orbit where the measuring holes 21 are formed, and adapted to mix the compressed gas from a compressed-gas supply source and the abrasive contained in each of the measuring holes 21 and to deliver the resultant mixed fluid to an abrasive transport path 51;

wherein the abrasive mixing section 40 includes a cylinder (first cylinder 41 in FIG. 1) which opens toward one surface of the rotating disc 20 at the position corresponding to a rotation orbit where the measuring holes 21 are formed; a cylinder (second cylinder 42 in FIG. 1) which faces the cylinder (first cylinder 41 in FIG. 1) via the rotating disc 20 and opens toward the other surface of the rotating disc 20; and pistons 43, 44 inserted into the respective cylinders 41, 42.

In the Embodiment, the abrasive mixing portion 40 has cylinders 41, 42 in casings 48, 49 integrally formed with a disc accommodation section 60.

One of the cylinders 41, 42 communicates with a compressed-gas supply source via a compressed-gas introduction path 52; the other one of the cylinders 41, 42 communicates with the abrasive transport path 51; and each of the pistons 43, 44 have through-holes 43*a*, 44*a* extending therethrough in such a manner as to coincide with the position where the measuring holes 21 are formed (See FIGS. 1, 6).

In FIG. 1, a pair of the cylinders 41, 42 are provided but not restricted thereto. In the present invention, a plurality of cylinders may be provided.

In another aspect of the present invention, the apparatus 1 for supplying a constant amount of abrasive which supplies a mixed fluid composed of a compressed gas and the abrasive, comprises:

a rotating disc 20 which rotates in a horizontal direction and has a plurality of measuring holes 21 having the same diameter, formed in such a manner as to pass through the rotating disc 20 in a thickness direction of the rotating disc 20, and disposed at equal intervals along a circumferential direction;

an abrasive charge section 30 for allowing the abrasive to fall therethrough without application of pressure so as to charge the abrasive into the measuring holes 21 of the rotating disc 20; and an abrasive mixing section 40 disposed in such a manner as to straddle the rotating disc 20 from opposite sides of the rotating disc 20 at a position corresponding to a rotation orbit where the measuring holes are formed, and adapted to mix the compressed gas from a compressed-gas supply source and the abrasive contained in each of the measuring holes 21 and to deliver the resultant mixed fluid to an abrasive transport path 51;

wherein the abrasive mixing section 40 includes a cylinder 41' which opens toward one surface of the rotating disc 20 at the position where the measuring holes are formed; a piston inserted into the cylinder 41'; and a fluid channel 45 which opens toward the cylinder 41' through the intermediary of the rotating disc 20 and whose opening rim 45*a* is formed in the casing 49 integrally formed with the disc accommodation section 60 in the Embodiment and is in sliding contact with another surface of the rotating disc 20; and one of the cylinder 41' and the fluid channel 45 communicates with a compressed-gas supply source through the intermediary of a compressed-gas introduction path 52; the other one of the cylinder 41' and the fluid channel 45 communicates with the abrasive transport path 51; and the piston 43' has a through-hole 43*a* passing therethrough in such a manner as to coincide with the position where the measuring holes 21 are formed (See FIGS. 4, 5).

The cylinder may open toward an upper surface of the rotating disc 20.

The cylinder may open toward a lower surface of the rotating disc 20.

Preferably, each of the pistons 43, 44, 43' has a cross-sectional area which is 5 times to 25 times that of the compressed-gas introduction path 52.

The pistons 43, 44, 43' may be formed such that at least a surface of contact with the rotating disc 20 is formed from high molecular weight polyethylene.

The pistons 43, 44 may be formed entirely from high molecular weight polyethylene.

The apparatus 1 may comprise a disc accommodation section 60 which accommodates the entire rotating disc 20 and is connected to the abrasive charge section 30 and to the abrasive mixing section 40.

The rotating disc 20 may be placed on a table which closes an underneath side of the measuring holes 21 moving from the abrasive charge section 30 to the abrasive mixing section 40.

The rotating disc 20 may be formed such that a central portion to which a rotating shaft is attached and a peripheral portion in which the measuring holes 21 are bored are formed as separate members, and the peripheral portion is attached to a circumference of the central portion in such a manner as to be movable in a vertical direction.

The measuring holes 21 may be provided in a line along a circumferential direction of the rotating disc 20.

The measuring holes 21 may be provided in a plurality of lines along a circumferential direction of the rotating disc 20.

The abrasive charge section 30 and the abrasive mixing section 40 may be provided for each line of the measuring holes 21.

The rotating disc 20 may be variable in rotational speed.

The compressed-gas introduction path 52, the abrasive transport path 51, the through-holes bored in the pistons 43, 44, and the measuring holes 21 bored in the rotating disc 20 may have the same cross-sectional shape in the width direction.

The abrasive charge section 30 may have an abrasive introduction source for continuously and appropriately introducing a required amount of dry ice particles or ice particles as abrasive into the abrasive charge section 30.

With the configuration according to the present invention described above, an apparatus 1 of the present invention can yield the effects described below while leaving intact the advantages of an existing apparatus for supplying a constant amount of abrasive; i.e., a rotating disc 20 having measuring holes 21 bored therein is rotated at a constant speed so as to transport the measuring holes 21 to an abrasive mixing section 40 for continuously transporting the abrasive contained in the measuring holes 21 to the abrasive mixing section 40, whereby the abrasive can be quantitatively transported to a destination member (e.g., a blast gun) through the intermediary of an abrasive transport path 51.

By virtue of provision of an abrasive charge section 30 for allowing abrasive to fall therethrough without application of pressure so as to charge the abrasive into the measuring holes 21, the abrasive can be introduced as appropriate into the abrasive charge section 30 without involvement of storage of a certain amount of abrasive. Thus, even in the case of use of dry ice particles, ice particles, or the like as abrasive, the abrasive can be constantly supplied in a constant amount without involvement of mutual adhesion of the particles.

Meanwhile, according to the aforementioned configuration of the abrasive mixing section 40, when a compressed gas from a compressed-gas supply source is introduced into cylinders 41, 42, 41' through the intermediary of a compressed-gas introduction path 52, the internal pressures of the cylinders 41, 42, 41' increase; accordingly, pistons 43, 44, 43' are thrust out from the cylinders 41, 42, 41' and are pressed against the rotating disc 20. Therefore, while the compressed gas from the compressed-gas supply source is introduced into the cylinders 41, 42, 41', the pistons 43, 44, 43' are in such a condition as to be pressed against the rotating disc 20.

As a result, a clearance which causes leakage of the compressed gas and the abrasive is not formed between the surface of the rotating disc 20 and each of the pistons 43, 44, 43'. Thus, communication is established between the compressed-gas introduction path 52, the measuring hole 21, and the abrasive transport path 51, through the intermediary of the through-holes 43*a* and 44*a* bored in the pistons 43, 44, 43' and without formation of a clearance therebetween. Therefore, while leakage of the compressed gas and the abrasive is prevented, the abrasive can be supplied accurately in a constant amount.

Furthermore, since the introduced compressed gas causes the pistons 43, 44, 43' to be pressed against the rotating disc 20, the following advantage is brought about. In association with accuracy in machining and mounting the rotating disc 20, for example, as shown in FIG. 9, a rotating disc 220 oscillates vertically in the course of rotation thereof; accordingly, a clearance between the upper surface of the rotating disc 220 and one end 212*a* of an air introduction path 212 varies in a range of δ1 to δ2. Even though the rotating disc 20 oscillates in such a manner, the pistons 43, 44, 43' follow the respective surfaces of the rotating disc 20, whereby the state of contact therebetween can be maintained; i.e., the formation of a clearance therebetween can be prevented.

Also, since the pistons 43, 44, 43' are in a state of being pressed against the respective surfaces of the rotating disc 20, even when the pistons 43, 44, 43' wear as a result of contact with the rotating disc 20, no clearance arises between the surface of the rotating disc 20 and each of the pistons 43, 44, 43'.

Particularly, in the case where the pistons 43, 44, 43' have a cross-sectional area which is 5 times to 25 times; for example, 15 times, that of the compressed-gas introduction path 52, a compressed gas having a pressure of 0.1 MPa to 0.5 MPa, which is usually used in a blasting process, can impart a thrust of 302 N to 1508 N (in the case of 15 times) to the pistons 43, 44, 43'. While being sufficiently large for preventing leakage of the compressed gas and the abrasive, such the thrust can establish such a contact condition as to minimize load imposed on a motor M for driving the rotary disc 20.

Furthermore, in the case where the pistons 43, 44, 43' are bored such that at least a surface of contact with the rotating disc 20 is formed from high molecular weight polyethylene; preferably, the pistons 43, 44, 43' are formed entirely from high molecular weight polyethylene, while good contact with the surface of the rotating disc 20 is established, frictional resistance on the contact surface can be reduced, whereby load imposed on the motor M can be further reduced.

In particular, in the case where the pistons 43, 44, 43' are formed entirely from high molecular weight polyethylene, the weight of the pistons 43, 44, 43' can be reduced; as a result, the pistons 43, 44, 43' can be operated easily through introduction of the compressed gas.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENTS

Embodiments of the present invention will next be described with reference to the accompanying drawings.

Overall Configuration

Figure 1:
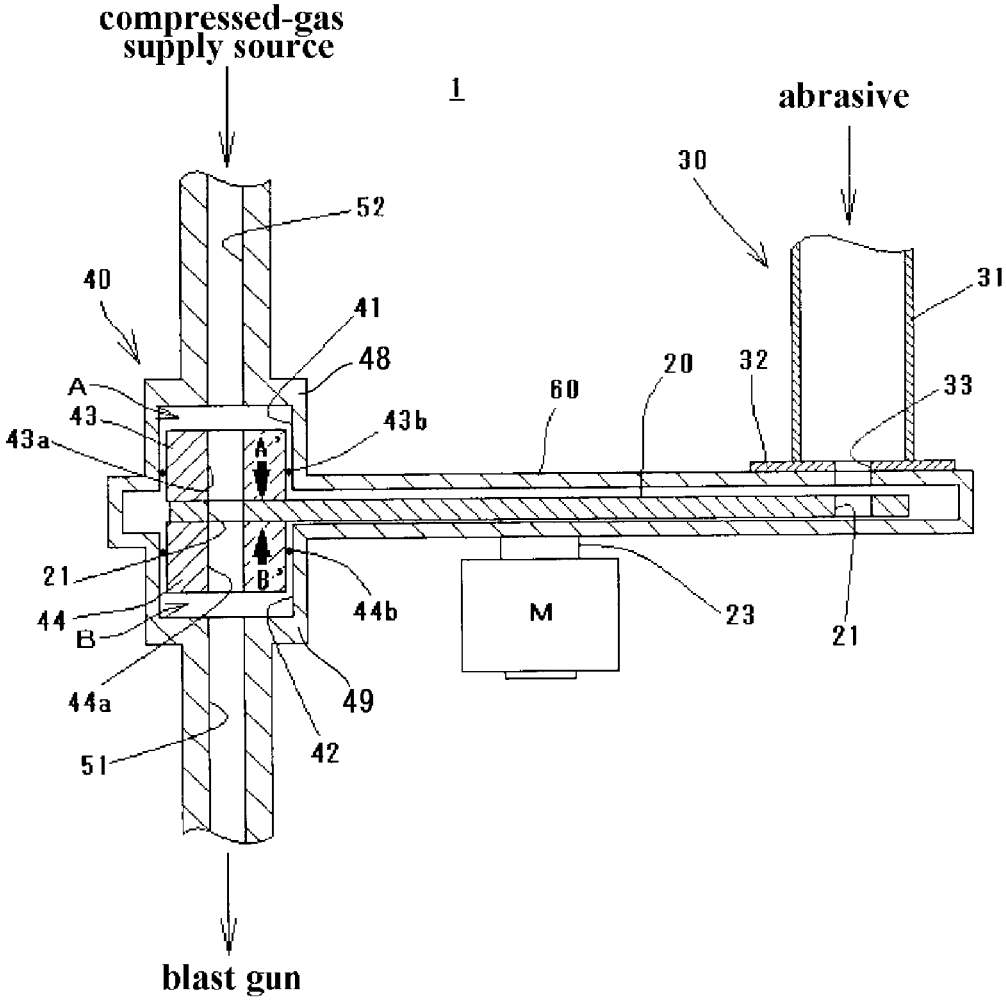
FIG. 1 is a schematic sectional view of an apparatus of the present invention.

Reference numeral 1 in FIG. 1 denotes an apparatus for supplying a constant amount of abrasive of the present invention. The apparatus 1 includes a rotating disc 20 having measuring holes 21 for measuring a constant amount of abrasive; an abrasive charge section 30 having an abrasive charge pipe 31 for introducing abrasive to and charging the abrasive into the measuring holes 21 in the rotating disc 20; and an abrasive mixing section 40 disposed in such a manner as to straddle the rotating disc 20 from opposite sides of the rotating disc 20 at a position corresponding to a rotation orbit where the measuring holes 21 are formed, and adapted to mix a compressed gas from a compressed-gas supply source and the abrasive contained in each of the measuring holes 21 and to deliver the resultant mixed fluid to an abrasive transport path 51.

Rotating Disc

The rotating disc 20 has a uniform thickness and is formed of, for example, a metal plate. The rotating disc 20 has a large number of measuring holes 21 provided in such a manner as to pass therethrough in the thickness direction thereof as shown in FIGS. 1 to 3.

The measuring holes 21 have the same diameter and thus have the same volume. By means of the measuring holes 21 being filled with abrasive, the abrasive can be measured in a constant amount.

Figure 2:
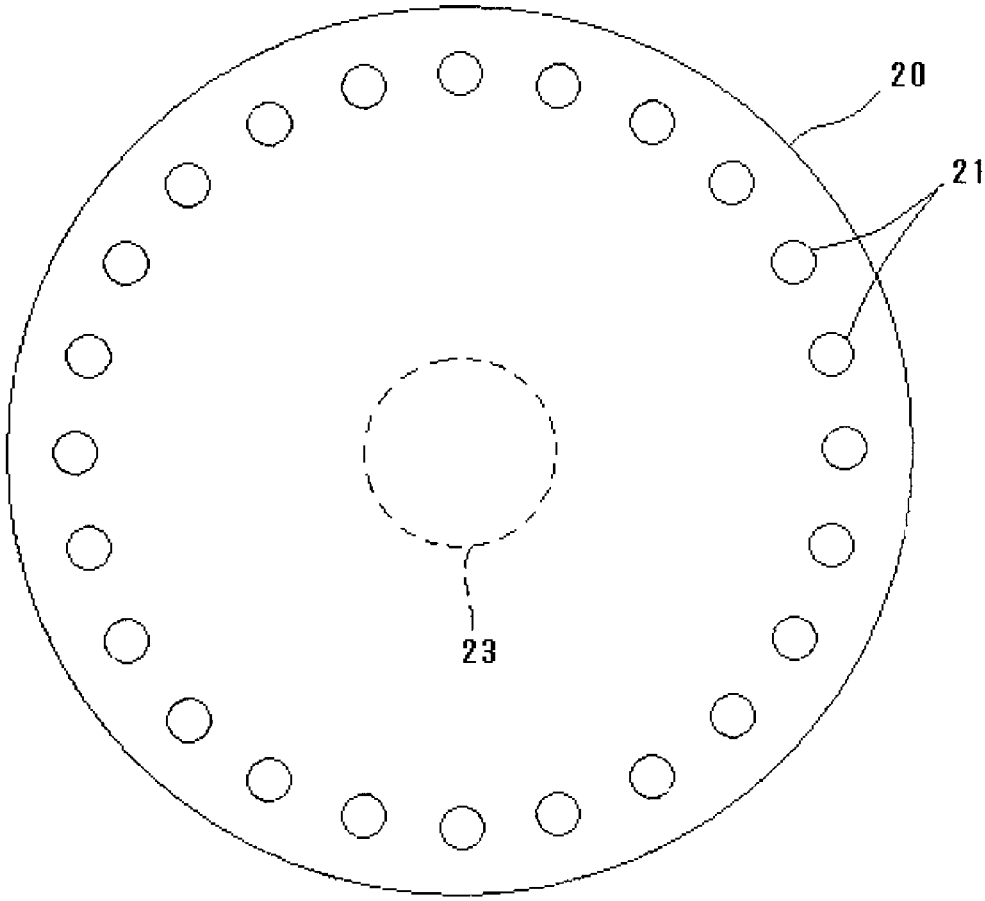
FIG. 2 is a plan view of a rotating disc.
Figure 3:
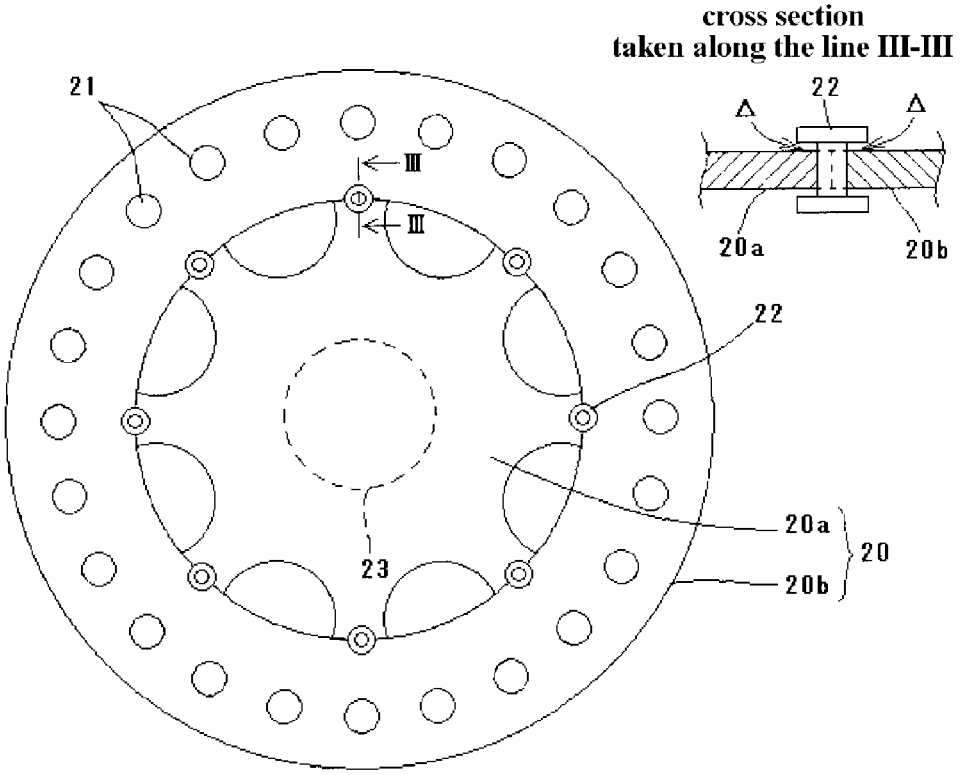
FIG. 3 is a plan view showing a modified rotating disc.

As shown in FIGS. 2 and 3, the measuring holes 21 are disposed on the same circumference at regular intervals. By virtue of such disposition of the measuring holes 21, by means of varying the rotational speed of the rotating disc 20, the amount of supply of abrasive can be varied accordingly.

A rotating shaft 23 is attached to the center of the thus-formed rotating disc 20. A drive motor M is coupled with the rotating shaft 23, whereby the rotating disc 20 can be rotated horizontally.

A stepping motor, for example, can be used as the motor M. The rotational speed of the stepping motor can be controlled with high accuracy according to, for example, the number of input pulses. By this procedure, the number of the measuring holes 21 which pass the abrasive mixing section 40, which will be described later, within a predetermined period of time can be varied with high accuracy. Therefore, the amount of supply of abrasive can be controlled with high accuracy.

Figure 7:
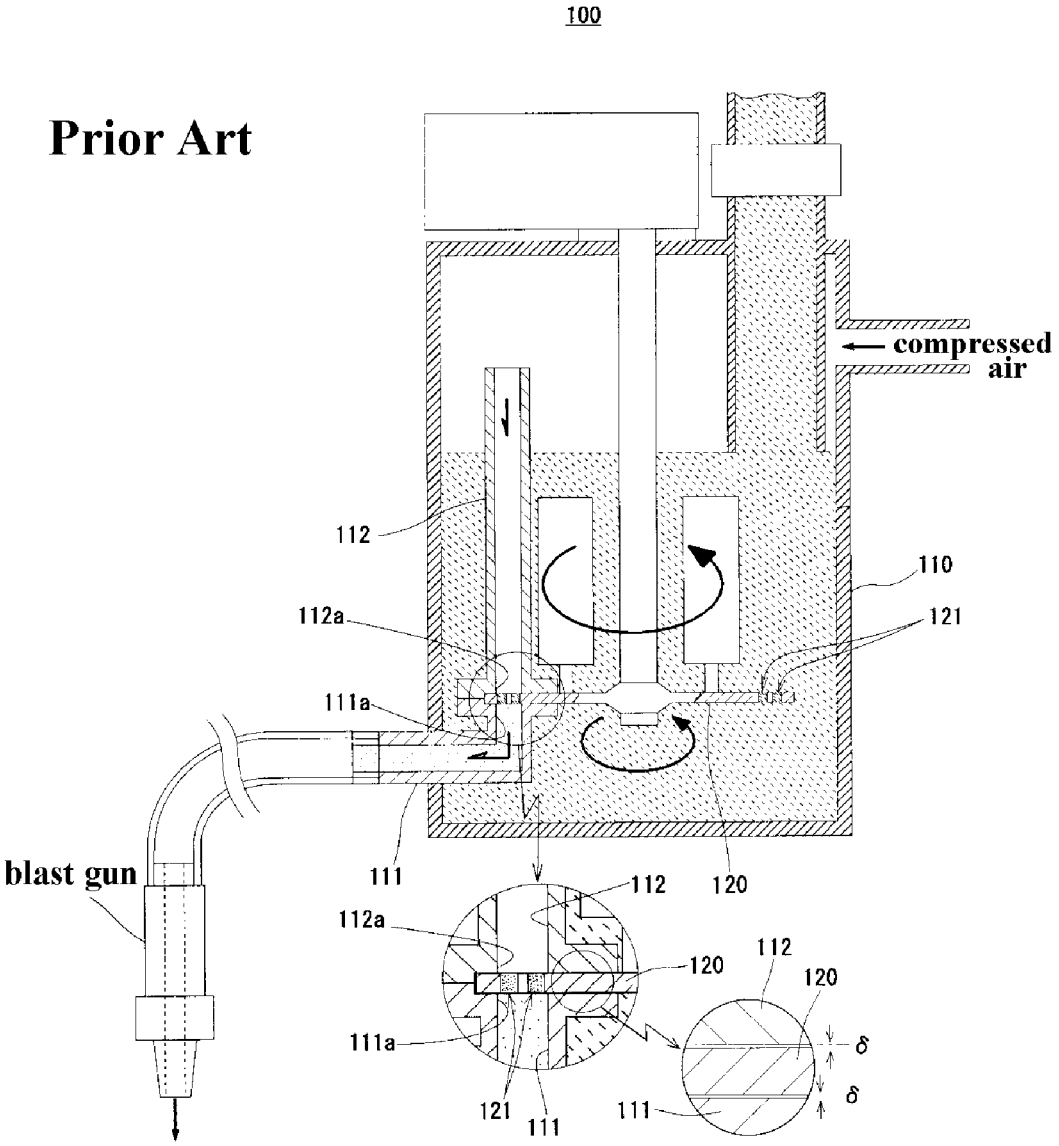
FIG. 7 is a schematic sectional view showing an existing apparatus.
Figure 8:
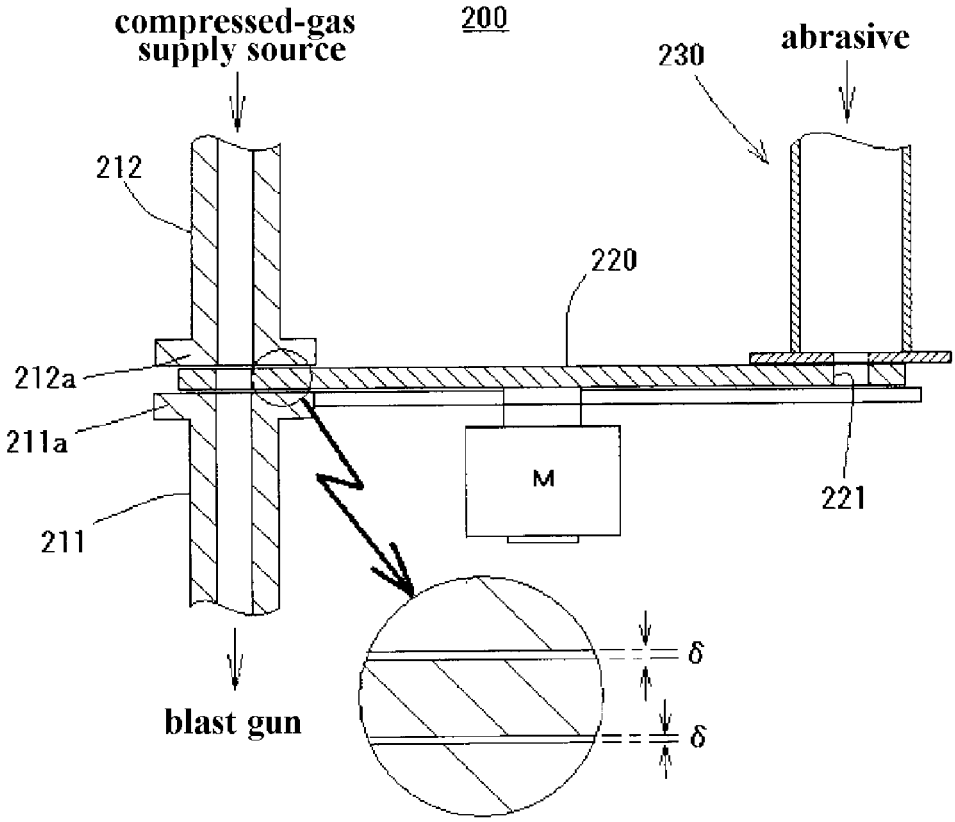
FIG. 8 is a schematic sectional view showing an apparatus in trial manufacture.

In the above description made with reference to FIGS. 1 to 3, the rotating disc 20 has the measuring holes 21 provided therein in a line. However, as in the case of the apparatus which has been described above with reference to FIG. 7 (Prior Art), the measuring holes may be provided in two lines. Also, the measuring holes may be provided in three or more lines.

In the example described above with reference to FIGS. 1 and 2, the rotating disc 20 is a one-piece disc formed from a metal plate. However, for example, as shown in FIG. 3, the rotating disc 20 may be composed of separate members; specifically, a central portion 20*a* and a peripheral portion 20*b*. The rotating shaft 23 is attached to the central portion 20*a*. The measuring holes 21 are bored in the peripheral portion 20*b*. The central portion 20*a* and the peripheral portion 20*b* are connected together into the rotating disc 20.

Figure 9:
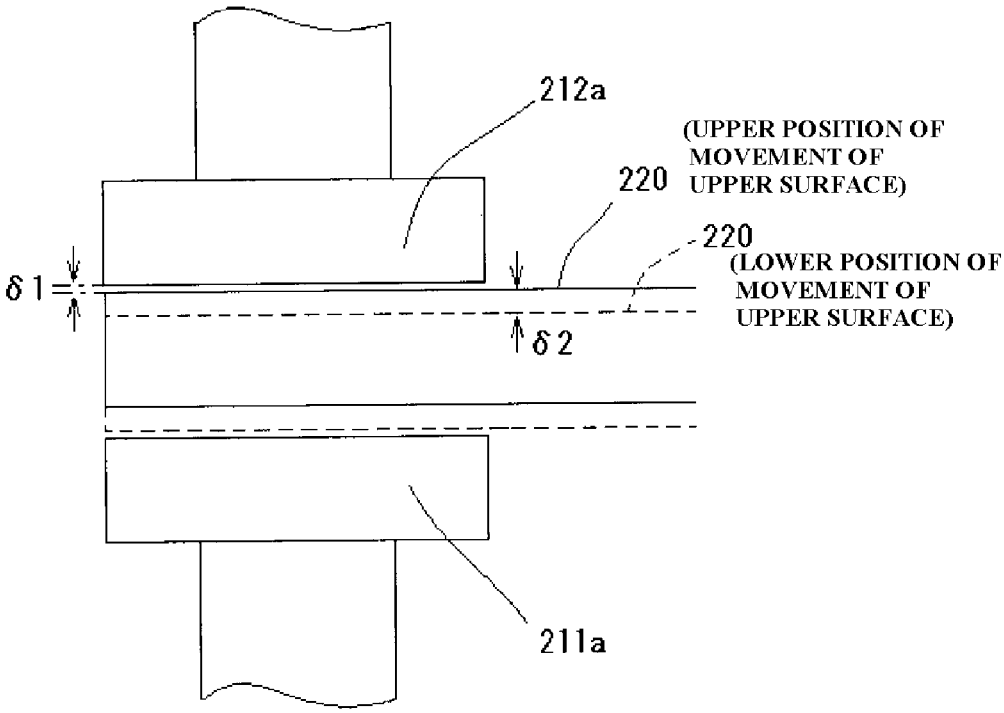
FIG. 9 is an explanatory view for explaining variation in rotation allowance clearance δ (δ1 to δ2) for rotation.

In this case, for example, as shown in the enlarged sectional view taken along line III-III in FIG. 3, the central portion 20*a* and the peripheral portion 20*b* are connected together with pins 22 in such a manner that the peripheral portion 20*b* is movable vertically relative to the central portion 20*a* over a range of clearance Δ. By virtue of this, even though, for example, as described above with reference to FIG. 9, the peripheral portion 20*b* of the rotating disc 20 oscillates vertically due to errors in machining the unitarily formed rotating disc 20 or errors in mounting the rotating disc 20 to the rotating shaft, such a positional deviation can be absorbed.

Abrasive Charge Section

In order to charge abrasive into the measuring holes 21 bored in the rotating disc 20 described above, the apparatus 1 of the present invention has the aforementioned abrasive charge section 30.

No particular limitation is imposed on the structure of the abrasive charge section 30, so long as abrasive which falls from an unillustrated abrasive supply source without application of pressure is introduced into the measuring holes 21, thereby filling the measuring holes 21. According to the illustrated embodiment, the abrasive charge pipe 31 has a cover plate 32 provided at the bottom thereof and having a hole whose shape corresponds to the measuring holes 21, and stands on the upper surface of the rotating disc 20. Through charge of abrasive into the abrasive charge pipe 31, in association with rotation of the rotating disc 20, the abrasive falls into the measuring holes 21 one after another, thereby filling the measuring holes 21.

As mentioned above, the abrasive charge section 30 allows abrasive to fall therethrough without application of pressure so as to introduce the abrasive into the measuring holes 21. As a result, as in the case of the existing apparatus described above with reference to FIG. 7 (Prior Art), even in the course of supply of abrasive in a constant amount, the abrasive charge section 30 can be replenished at all times with the abrasive.

As a result, even when dry ice particles, ice particles, or the like are used as abrasive, there is no need to store the abrasive within a container for a long period of time, thereby preventing a problem in that the particles adhere to one another by the effect of moisture in air, or a like problem. Therefore, dry ice particles, ice particles, or the like, which the existing apparatus described above with reference to FIG. 7 (Prior Art) cannot handle, can be used as abrasive to be supplied in a constant amount.

The apparatus 1 of the present invention can employ dry ice particles, ice particles, or the like as abrasive. However, this should not be construed as limiting, to dry ice particles and ice particles, the abrasive which the apparatus of the present invention supplies in a constant amount. Needless to say, the apparatus of the present invention can supply known various abrasives in a constant amount.

Abrasive Mixing Section

In association with rotation of the rotating disc 20, the measuring holes 21 which have been filled with abrasive in the abrasive charge section 30 described above move to the abrasive mixing section 40. In the abrasive mixing section 40, the abrasive contained in each of the measuring holes 21 is mixed with a compressed gas. The resultant mixed fluid is delivered from the abrasive mixing section 40 and then supplied to, for example, an unillustrated blast gun.

As shown in FIG. 1 and FIGS. 4 to 6, the abrasive mixing section 40 is formed in such a manner as to straddle the rotating disc 20 from opposite sides of the rotating disc 20. Also, the abrasive mixing section 40 is configured such that the compressed gas from a compressed-gas supply source is introduced, through the intermediary of each of the measuring holes 21, into the abrasive transport path 51 which communicates with a blast gun or the like, thereby supplying a constant amount of abrasive in the form of a mixed fluid composed of the compressed gas and the abrasive.

In the example shown in FIG. 1, the abrasive mixing section 40 includes a first cylinder 41 which opens toward the upper surface of the rotating disc 20; a second cylinder 42 which faces the first cylinder 41 through the intermediary of the rotating disc 20 and opens toward the lower surface of the rotating disc 20; and first and second pistons 43 and 44 inserted into the first and second cylinders 41 and 42, respectively.

The compressed-gas supply source is made to communicate with the first cylinder 41 through the intermediary of the compressed-gas introduction path 52. The abrasive transport path 51 is made to communicate with the second cylinder 42. Furthermore, through-holes 43*a* and 44*a* are provided in the first and second pistons 43 and 44, respectively, in such a manner as to coincide with a position corresponding to a rotation orbit where the measuring holes 21 are formed. A compressed gas is introduced into the first cylinder 41 from the compressed-gas supply source through the intermediary of the compressed-gas introduction path 52. Then, when the compressed gas introduced into the first cylinder 41 passes through the relevant measuring hole 21 of the rotating disk 20 through the intermediary of the through-hole 43*a* in the first piston 43, the compressed gas is mixed with abrasive. Subsequently, the resultant mixed fluid composed of the compressed gas and the abrasive flows into the second cylinder 42 through the intermediary of the through-hole 44*a* in the second piston 44. Then, the mixed fluid is supplied to an unillustrated blast gun through the intermediary of the abrasive transport path 51.

The first and second pistons 43 and 44 are inserted into the first and second cylinders 41 and 42, respectively, in a retractable condition. In the illustrated example, piston rings 43*b* and 44*b* are attached to the first and second pistons 43 and 44, respectively, thereby providing a seal against the inner walls of the cylinders 41 and 42.

As a result, when the compressed gas is introduced into the abrasive mixing section 40 from the compressed-gas supply source through the intermediary of the compressed-gas introduction path 52, the pressures of spaces A and B in the cylinders 41 and 42, respectively, increase, thereby imposing thrusts indicated by the arrows A' and B' in FIG. 1 on the first and second pistons 43 and 44, respectively.

Thus, the rotating disc 20 is held between the first and second pistons 43 and 44. Also, the end surfaces of the pistons 43 and 44 which encompass the opening rims of the through-holes 43*a* and 44*a* partially constituting a flow path are brought in close contact with the front and back surfaces, respectively, of the rotating disc 20, thereby preventing leakage of the compressed gas and the abrasive from the flow path.

Metal, resin, and other various materials can be used to form the first and second pistons 43 and 44, which come into contact with the rotating disc 20 as mentioned above. No particular limitation is imposed on material for the first and second pistons 43 and 44. However, preferably, the first and second pistons 43 and 44 are formed such that at least a portion of contact with the rotating disc 20 is formed from high molecular weight polyethylene.

High molecular weight polyethylene is known to be a substance having low frictional resistance. In some cases, for example, a sheet of high molecular weight polyethylene is held between sliding members for use as a substitute for a bearing or lubricant.

Therefore, by means of using such a material to form contact portions of the pistons 43 and 44 with the rotating disc 20, resistance to rotation of the rotating disc 20 which results from holding the rotating disc 20 between the pistons 43 and 44 can be mitigated, thereby reducing load imposed on the drive motor M.

Particularly, in the case where the first and second pistons 43 and 44 are formed entirely from high molecular weight polyethylene, the first and second pistons 43 and 44 can be reduced in weight as compared with the first and second pistons 43 and 44 formed from metal or the like. Therefore, the first and second pistons 43 and 44 can be operated easily by means of the compressed gas introduced from the compressed-gas supply source.

Preferably, the compressed-gas introduction path 52, the abrasive transport path 51, the through-holes 43*a* and 44*a* in the first and second pistons 43 and 44, and the measuring holes 21 bored in the rotating 20 disc have the same cross-sectional shape in the width direction. By virtue of this, the compressed-gas can be introduced smoothly into a series of these flow paths, and the abrasive mixed with the compressed gas can be transported smoothly to a destination device.

The thrusts imposed on the first and second pistons 43 and 44 must be of such a magnitude as not to induce an excessively large resistance to rotation of the rotating disc 20 and of such a magnitude as to prevent leakage of the compressed gas and the abrasive along the contact interface between the rotating disc 20 and each of the pistons 43 and 44. In order to attain such a state of contact, preferably, the first and second pistons 43 and 44 each have a cross-sectional area which is about 5 times to 25 times that of the compressed-gas introduction path 52, the abrasive transport path 51, each of the through-holes 43*a* and 44*a* bored in the first and second pistons 43 and 44, and each of the measuring holes 21 bored in the rotating disc 20. In the present embodiment, the first and second cylinders 41 and 42 each have an inside diameter of 64 mm, and the compressed-gas introduction path 52, the abrasive transport path 51, the through-holes 43*a* and 44*a* bored in the first and second pistons 43 and 44, and the measuring holes 21 bored in the rotating disc 20 have an inside diameter of 16 mm. Thus, the cross-sectional area of the bore of each of the cylinders 41 and 42 is about 16 times that of the compressed-gas introduction path 52, etc. The cross-sectional area of each of the pistons 43 and 44 (the cross-sectional area which excludes that of each of the through-holes 43*a* and 44*a*) is about 15 times that of the compressed-gas introduction path 52, etc.

Thus, when a compressed-gas having a pressure of 0.1 MPa to 0.5 MPa is introduced from the compressed-gas supply source, each of the thrusts A' and B' imposed on the pistons 43 and 44, respectively, can be about 302 N to 1,508 N. The thrusts A' and B' of such a magnitude do not impose an excessively large load on the motor M used to rotate the rotating disc 20 and can favorably prevent leakage of the compressed gas and the abrasive along the contact surface between the rotating disc 20 and each of the pistons 43 and 44.

According to the embodiment described above with reference to FIG. 1, the abrasive mixing section 40 includes the first and second cylinders 41 and 42 which open toward the front surface and the back surface, respectively, of the rotating disc 20, and the pistons 43 and 44 are inserted into the first and second cylinders 41 and 42, respectively. In place of this configuration, the following configuration may be employed. As exemplified in FIG. 4 or 5, the abrasive mixing section 40 includes a cylinder 41' which opens toward one of the front and back surfaces of the rotating disc 20; a piston 43' inserted into the cylinder 41'; and a fluid channel 45 which opens toward the cylinder 41' through the intermediary of the rotating disc 20 and whose opening rim 45*a* is in sliding contact with another surface of the rotating disc 20. One of the cylinder 41' and the fluid channel 45 communicates with the compressed-gas supply source through the intermediary of the compressed-gas introduction path 52; the other one of the cylinder 41' and the fluid channel 45 communicates with the abrasive transport path 51; and the piston 43' has the through-hole 43*a* penetrating the piston 43' at a position extended from each of the measuring holes 21.

Figure 4:
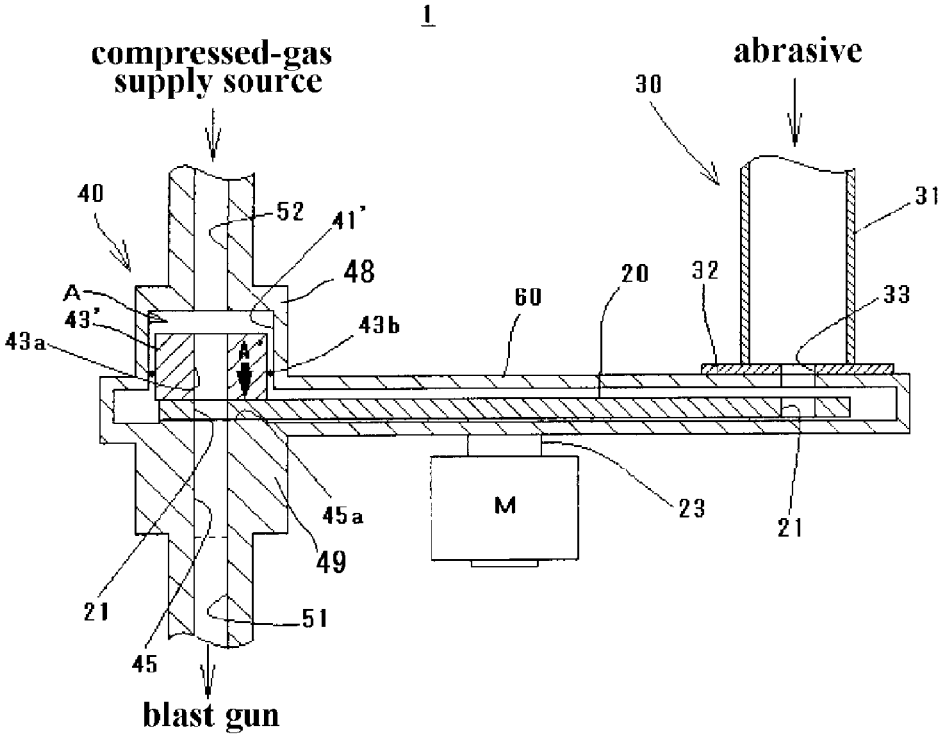
FIG. 4 is a schematic sectional view showing a modified apparatus of the present invention.

In the example shown in FIG. 4, the fluid channel 45 is provided continuous to an end portion of the abrasive transport path 51. In the example shown in FIG. 5, the fluid channel 45 is provided continuous to an end portion of the compressed-gas introduction path 52.

Even in the apparatus 1 having the abrasive mixing section 40 which is configured as mentioned above, when the compressed gas is introduced into the cylinder 41' from the compressed-gas supply source, thrust A' or B' is imposed on the piston 43' inserted into the cylinder 41', thereby pressing the piston 43' against the rotating disc 20. Thus, the rotating disc 20 is held between the piston 43' and the opening rim 45*a* of the fluid channel 45. As a result, similar to the case of the apparatus 1 described above with reference to FIG. 1, the occurrence of pressure loss associated with, for example, leakage of the compressed gas or the occurrence of abrasive loss can be prevented. Therefore, the abrasive can be supplied in a constant amount with high accuracy.

Figure 5:
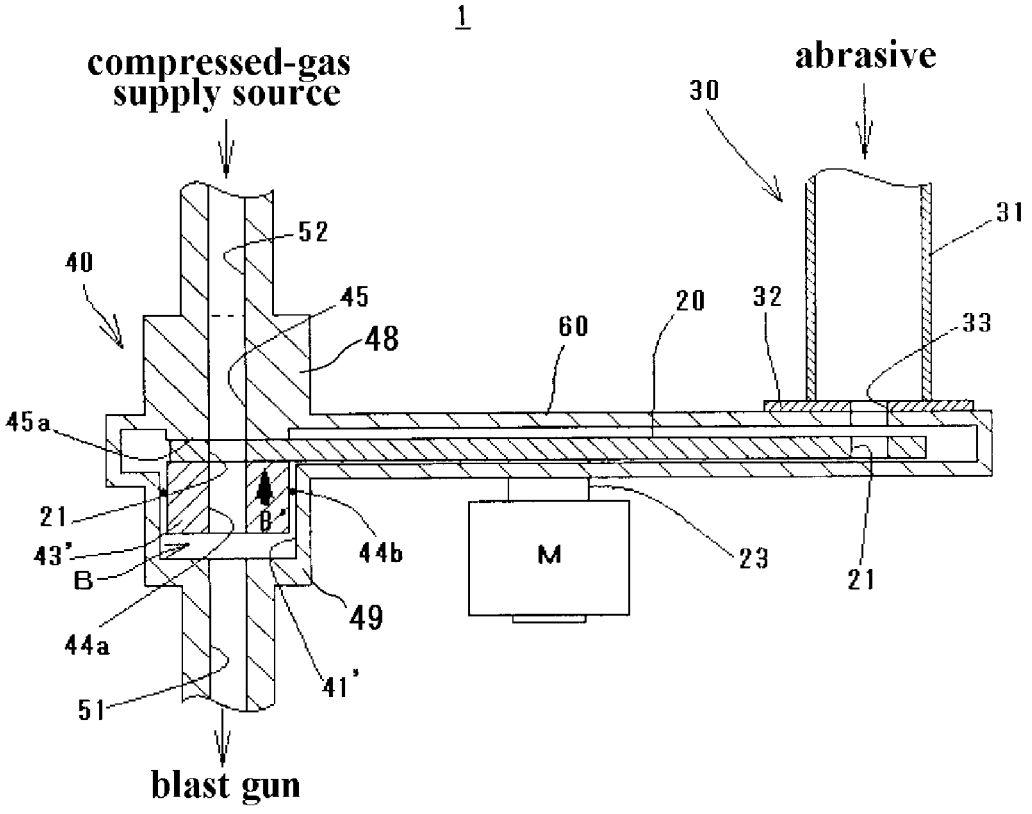
FIG. 5 is a schematic sectional view showing another modified apparatus of the present invention.

In the configurations shown in FIGS. 4 and 5, preferably, similar to the case of the pistons 43 and 44 described above, high molecular weight polyethylene is, for example, affixed to the opening rim 45*a* of the fluid channel 45 which is in sliding contact with the surface of the rotating disc 20.

In the configuration in which the cylinder 41' and the piston 43' are provided only on one side of the rotating disc 20 as shown in FIGS. 4 and 5, in order to maintain a good condition of contact between the surface of the rotating disc 20 and the opening rim 45*a* of the fluid channel 45 at all times, preferably, as described above with reference to FIG. 3, the rotating disc 20 is configured such that the separately formed central portion 20*a* and peripheral portion 20*b* are connected together with, for example, the pins 22.

Others

Figure 6:
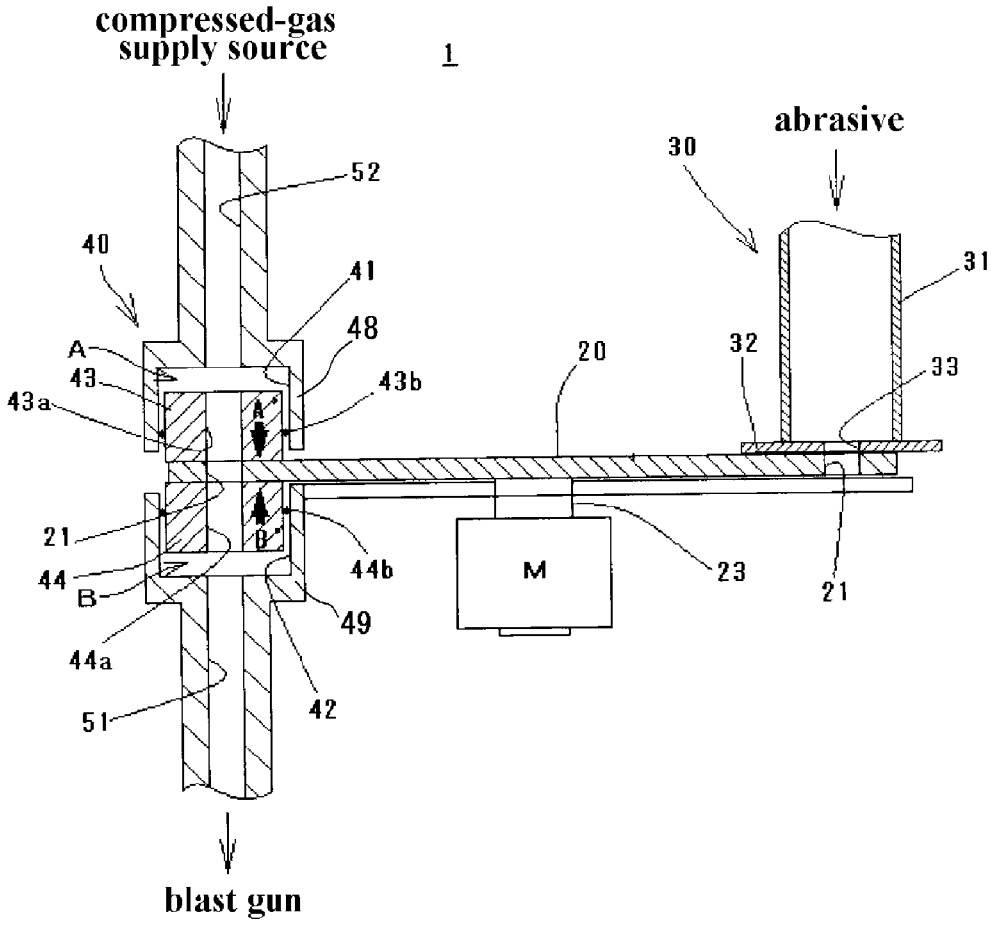
FIG. 6 is a schematic sectional view showing still another modified apparatus of the present invention.

In the apparatus 1 described above with reference to FIGS. 1, 4, and 5, a disc accommodation section 60 is provided for covering the entire rotating disc 20. However, the entire rotating disc 20 is not necessarily covered with the disc accommodation section 60. For example, as shown in FIG. 6, the rotating disc 20 may be covered only at an underneath side of the measuring holes 21 filled with abrasive while allowing the other portion of the rotating disc 20 to be exposed to the outside of the apparatus 1, so long as the abrasive contained in the measuring holes 21 can stay within the measuring holes 21 until the measuring holes 21 reach the abrasive mixing section 40.

Working Effects

In the thus-configured apparatus 1, while abrasive is introduced continuously into the abrasive charge pipe 31 of the abrasive charge section 30, and a compressed gas from an unillustrated compressed-gas supply source; for example, an air compressor, is introduced into the abrasive mixing section 40 through the intermediary of the compressed-gas introduction path 52, the rotating disc 20 is rotated by means of the drive motor M. By this operation, the abrasive is mixed with the compressed gas within the abrasive mixing section 40, and the resultant mixed fluid is supplied in a constant amount through the intermediary of the abrasive transport path 51, to a destination device; for example, a blast gun, provided at the distal end of the abrasive transport path 51.

In the existing apparatus described above with reference to FIG. 7 (Prior Art), the rotating disc and the abrasive are accommodated within the pressure vessel, and the abrasive is charged into the measuring holes of the rotating disc under pressure. Therefore, in the case of using dry ice particles or ice particles as abrasive, the abrasive particles adhere to one another to form lumps, resulting in a failure to charge the measuring holes with the abrasive particles.

However, in the apparatus 1 of the present invention, the abrasive charge section 30 is provided for allowing abrasive to fall therethrough without application of pressure so as to charge the abrasive into the measuring holes of the rotating disc 20. Thus, in the case of using the dry ice particles or ice particles as abrasive, the fine particles of dry ice or ice can be introduced continuously in a required amount into the cylindrical body of the abrasive charge section 30 so as to avoid mutual adhesion of the particles.

The abrasive which is introduced as mentioned above into the abrasive charge pipe 31 of the abrasive charge section 30 is charged into the measuring holes 21 of the rotating disc 20 through a hole 33 provided in the cover plate 32 which covers the bottom of the abrasive charge pipe 31. By means of the drive motor M rotating the rotating disc 20, the measuring holes 21 empty of the abrasive are sequentially transported to the abrasive charge section 30 and charged with the abrasive. The measuring holes 20 filled with the abrasive are sequentially transported to the abrasive mixing section 40.

When the compressed gas is introduced into the abrasive mixing section 40 from the compressed-gas supply source through the intermediary of the compressed-gas introduction path 52, in the case of the example shown in FIG. 1, the pressures of the spaces A and B in the cylinders 41 and 42, respectively, increase, thereby imposing thrusts on the pistons 43 and 44 in the directions indicated by the arrows A' and B', respectively. Accordingly, the rotating disc 20 is held between the two pistons 43 and 44.

As a result of the rotating disc 20 being held between the pistons 43 and 44 as mentioned above, the opposite ends of each of the measuring holes 21, which are through-holes bored in the rotating disc 20, are connected to the through-holes 43*a* and 44*a* bored in the pistons 43 and 44, thereby forming a series of flow paths. Since the pistons 43 and 44 are in contact with the front and back surfaces, respectively, of the rotating disc 20, no clearance arises at the connections between each of the measuring holes 21 and the through-holes 43*a* and 44*a*.

As a result, the compressed gas and the abrasive do not leak out from the above-mentioned flow paths along the contact interface between the rotating disc 20 and each of the pistons 43 and 44. Therefore, the abrasive can be supplied in a constant amount with high accuracy.

Through establishment of communication between each of the measuring holes 21 and the through-holes 43*a* and 44*a* in the pistons 43 and 44, the compressed gas which is introduced into the cylinder 41 from the compressed-gas supply source through the intermediary of the compressed-gas introduction path 52 is blown into the measuring hole 21 through the intermediary of the through-hole 43*a* in the piston 43. Thus, the abrasive contained in the measuring hole 21, together with the compressed gas, is blown into the through-hole 44*a* in the second piston 44. The resultant mixed fluid composed of the abrasive and the compressed gas is supplied to a destination device, such as an unillustrated blast gun, through the intermediary of the second cylinder 42 and the abrasive transport path 51, which communicates with the second cylinder 42.

In the above description, as shown in FIG. 1, the compressed gas is introduced into the abrasive mixing section 40 from above the abrasive mixing section 40. However, the compressed-gas introduction path 52 and the abrasive transport path 51 may be positionally replaced with each other such that the compressed gas is introduced from the underneath side of the rotating disc 20, while the abrasive is supplied to a destination device, such as a blast gun, from above the rotating disc 20. Such a configuration can also be applied to the apparatus described above with reference to FIGS. 4, 5, and 6.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

DESCRIPTIONS OF REFERENCE NUMERALS

1. Apparatus for supplying a constant amount of abrasive
20. Rotating disc
20*a*. Central portion (of the rotating disc 20)
20*b*. Peripheral portion (of the rotating disc 20)
21. Measuring holes
22. Pins
23. Rotating shaft
30. Abrasive charge section
31. Abrasive charge pipe
32. Cover plate
33. Hole
40. Abrasive mixing section
41. Cylinder (first)
41'. Cylinder
42. Cylinder (second)
43. Piston (first)
43'. Piston
43*a*. Through-hole
43*b*. Piston ring
44. Piston (second)
44*a*. Through-hole
44*b*. Piston ring
45. Fluid channel
45*a*. Opening rim
48. Casing
49. Casing
51. Abrasive transport path
52. Compressed-gas introduction path
60. Disc accommodation section
M. Motor
100. Apparatus for supplying a constant amount of abrasive
110, 210. Abrasive tanks
111, 211. Abrasive transport paths
111*a*, 211*a*. One ends (of abrasive transport paths 111, 211)
112, 212. Air introduction paths
112*a*, 212*a*. One ends (of air introduction paths 112, 212)
120, 220. Rotating discs
121, 221. Measuring holes
230. Abrasive charge section

What is claimed is:

1. An apparatus for supplying a constant amount of abrasive which supplies a mixed fluid composed of a compressed gas and the abrasive, comprising:

a rotating disc which rotates in a horizontal direction and has a plurality of measuring holes having the same diameter, formed in such a manner as to pass through the rotating disc in a thickness direction of the rotating disc, and disposed at equal intervals along a circumferential direction;

an abrasive charge section for allowing the abrasive to fall therethrough without application of pressure so as to charge the abrasive into the measuring holes of the rotating disc; and an abrasive mixing section disposed in such a manner as to straddle the rotating disc from opposite sides of the rotating disc at a position corresponding to a rotation orbit where the measuring holes are formed, and adapted to mix the compressed gas from a compressed-gas supply source and the abrasive contained in each of the measuring holes and to deliver the resultant mixed fluid to an abrasive transport path;

wherein the abrasive mixing section includes a cylinder which opens toward one surface of the rotating disc at the position where the measuring holes are formed; a piston inserted into the cylinder; and a fluid channel which opens toward the cylinder through the intermediary of the rotating disc and whose opening rim is in sliding contact with another surface of the rotating disc; and one of the cylinder and the fluid channel communicates with a compressed-gas supply source through the intermediary of a compressed-gas introduction path; the other one of the cylinder and the fluid channel communicates with the abrasive transport path; and the piston has a through-hole passing therethrough in such a manner as to coincide with the position where the measuring holes are formed.

2. An apparatus for supplying a constant amount of abrasive which supplies a mixed fluid composed of a compressed gas and the abrasive, comprising:

a rotating disc which rotates in a horizontal direction and has a plurality of measuring holes having the same diameter, bored in such a manner as to pass through the rotating disc in a thickness direction of the rotating disc, and disposed at equal intervals along a circumferential direction;

an abrasive charge section for allowing the abrasive to fall therethrough without application of pressure so as to charge the abrasive into the measuring holes of the rotating disc; and an abrasive mixing section disposed in such a manner as to straddle the rotating disc from opposite sides of the rotating disc at a position corresponding to a rotation orbit where the measuring holes are formed, and adapted to mix the compressed gas from a compressed-gas supply source and the abrasive contained in each of the measuring holes and to deliver the resultant mixed fluid to an abrasive transport path;

wherein the abrasive mixing section includes a cylinder which opens toward one surface of the rotating disc at the position where the measuring holes are formed; a cylinder which faces said cylinder through the intermediary of the rotating disc and opens toward another surface of the rotating disc; and pistons inserted into the respective cylinders; and one of the cylinders communicates with a compressed-gas supply source through the intermediary of a compressed-gas introduction path; the other one of the cylinders communicates with the abrasive transport path; and each of the pistons has a through-hole passing therethrough in such a manner as to coincide with the position where the measuring holes are formed.

3. An apparatus for supplying a constant amount of abrasive according to claim 1, wherein the cylinder opens toward an upper surface of the rotating disc.

4. An apparatus for supplying a constant amount of abrasive according to claim 1, wherein the cylinder opens toward a lower surface of the rotating disc.

5. An apparatus for supplying a constant amount of abrasive according to claim 1, wherein the pistons each have a cross-sectional area which is 5 times to 25 times that of the compressed-gas introduction path.

6. An apparatus for supplying a constant amount of abrasive according to claim 2, wherein the pistons each have a cross-sectional area which is 5 times to 25 times that of the compressed-gas introduction path.

7. An apparatus for supplying a constant amount of abrasive according to claim 1, wherein the pistons are formed such that at least a surface of contact with the rotating disc is formed from high molecular weight polyethylene.

8. An apparatus for supplying a constant amount of abrasive according to claim 2, wherein the pistons are formed such that at least a surface of contact with the rotating disc is formed from high molecular weight polyethylene.

9. An apparatus for supplying a constant amount of abrasive according to claim 7, wherein the pistons are formed entirely from high molecular weight polyethylene.

10. An apparatus for supplying a constant amount of abrasive according to claim 8, wherein the pistons are formed entirely from high molecular weight polyethylene.

11. An apparatus for supplying a constant amount of abrasive according to claim 1, further comprising a disc accommodation section which accommodates the entire rotating disc and is connected to the abrasive charge section and to the abrasive mixing section.

12. An apparatus for supplying a constant amount of abrasive according to claim 2, further comprising a disc accommodation section which accommodates the entire rotating disc and is connected to the abrasive charge section and to the abrasive mixing section.

13. An apparatus for supplying a constant amount of abrasive according to claim 1, wherein the rotating disc is placed on a table which closes an underneath of the measuring holes moving from the abrasive charge section to the abrasive mixing section.

14. An apparatus for supplying a constant amount of abrasive according to claim 2, wherein the rotating disc is placed on a table which closes an underneath of the measuring holes moving from the abrasive charge section to the abrasive mixing section.

15. An apparatus for supplying a constant amount of abrasive according to claim 1, wherein the rotating disc is formed such that a central portion to which a rotating shaft is attached and a peripheral portion in which the measuring holes are bored are formed as separate members, and the peripheral portion is attached to a circumference of the central portion in such a manner as to be movable in a vertical direction.

16. An apparatus for supplying a constant amount of abrasive according to claim 2, wherein the rotating disc is formed such that a central portion to which a rotating shaft is attached and a peripheral portion in which the measuring holes are bored are formed as separate members, and the peripheral portion is attached to a circumference of the central portion in such a manner as to be movable in a vertical direction.

17. An apparatus for supplying a constant amount of abrasive according to claim 1, wherein the compressed-gas introduction path, the abrasive transport path, the through-holes bored in the pistons, and the measuring holes bored in the rotating disc have the same cross-sectional shape in the width direction.

18. An apparatus for supplying a constant amount of abrasive according to claim 2, wherein the compressed-gas introduction path, the abrasive transport path, the through-holes bored in the pistons, and the measuring holes bored in the rotating disc have the same cross-sectional shape in the width direction.

19. An apparatus for supplying a constant amount of abrasive according to claim 1, wherein the abrasive charge section has an abrasive introduction source for continuously and appropriately introducing a required amount of dry ice particles or ice particles as abrasive into the abrasive charge section.

20. An apparatus for supplying a constant amount of abrasive according to claim 2, wherein the abrasive charge section has an abrasive introduction source for continuously and appropriately introducing a required amount of dry ice particles or ice particles as abrasive into the abrasive charge section.

* * * * *